US006539884B1

(12) United States Patent
Husain et al.

(10) Patent No.: US 6,539,884 B1
(45) Date of Patent: Apr. 1, 2003

(54) CLOSED LOOP CONTROL OF VOLATILE ORGANIC COMPOUND EMISSIONS FROM THE TANKS OF OIL TANKERS, INCLUDING AS MAY BE SIMULTANEOUSLY SAFEGUARDED FROM SPILLAGE OF OIL BY AN UNDERPRESSURE SYSTEM

(75) Inventors: Mo Husain, Encinitas, CA (US); Henry Hunter, San Marcos, CA (US)

(73) Assignee: MH Systems Corporation, San Diego, CA (US)

( * ) Notice: Subject to any disclaimer, the term of this patent is extended or adjusted under 35 U.S.C. 154(b) by 0 days.

(21) Appl. No.: 09/865,414

(22) Filed: May 25, 2001

(51) Int. Cl.[7] ..... B63B 25/08
(52) U.S. Cl. ..... 114/74 R; 210/764
(58) Field of Search ..... 114/74 R; 210/757, 210/764

(56) References Cited

U.S. PATENT DOCUMENTS 4,338,874 A * 7/1982 Shaw et al. ..... 114/50
5,092,259 A * 3/1992 Husain ..... 114/229
5,156,109 A * 10/1992 Husain ..... 114/72
5,285,745 A * 2/1994 Husain ..... 114/211
5,323,724 A * 6/1994 Husain ..... 114/72
5,343,822 A * 9/1994 Husain ..... 114/72
5,551,367 A * 9/1996 Vitkauskas ..... 114/74 R

* cited by examiner

*Primary Examiner*—Jesus D. Sotelo
(74) *Attorney, Agent, or Firm*—Fuess & Davidenas

(57) ABSTRACT

Upon loading of oil cargo the ullage space of a tank of an oil tanker is sealed substantially gas tight with the gaseous contents of the ullage space both (i) initially inerted so as to be incapable of supporting combustion of any oil within the tank, and (ii) at an initial pressure less than atmosphere. The tank is preferably continued closed, preferably optionally with closed loop recirculation for purposes of gas mixing, for the entire voyage of the tanker save that (1) ullage space gas pressure uncommonly exceeds limits because of any of (i) leakage of atmospheric gases into the tank, and/or (ii) outgassing of gases within the oil contents of the tank, (iii) evaporation of the oil or portions thereof, and/or (iv) expansion of the ullage space gases upon thermal heating, and/or (2) free oxygen within the ullage space gases exceeds limits because of any leakage of atmospheric gases into the tank, at which time the tank is re-inerted, preferably with flue gases, or again de-pressurized, as and when required. Normally ullage space gas pressure remains, nonetheless to potentially becoming more positive, suitably negative throughout the entire voyage of the tanker, continuously preventing that hydrostatic pressure within the tank should equalize with a surrounding ocean upon any occasion of incipient rupture of the tank below the water line and thus continuously precluding at least some outflow of oil as would otherwise occur upon the occasion of the rupture. Normally free oxygen within the ullage space gases remains, nonetheless to potentially increasing, suitably low throughout the entire voyage of the tanker so as to prevent that combustion should occur.

18 Claims, 3 Drawing Sheets

CLOSED LOOP CONTROL OF VOLATILE ORGANIC COMPOUND EMISSIONS FROM THE TANKS OF OIL TANKERS, INCLUDING AS MAY BE SIMULTANEOUSLY SAFEGUARDED FROM SPILLAGE OF OIL BY AN UNDERPRESSURE SYSTEM

BACKGROUND OF THE INVENTION

1. Field of the Invention

The present invention generally concerns the simultaneous control of both (i) gaseous emissions, and, in the event of rupture, (ii) spillage, from the loaded tanks of oil tankers.

The present invention particularly concerns the control of both the (i) pressure, and the (ii) constituent components, of ullage space gases in the tanks of oil tankers to the ends of eliminating or abating both (i) gaseous emission of volatile organic compounds (VOCs), and (ii) spillage of oil upon the occasion of rupture, from the tanks.

2. Description of the Prior Art

The transport of crude oil in tankers holds the potential for polluting the environment both from (i) gaseous emissions and (ii) oil spills. The present invention will be seen to deal with abating both aspects of pollution from oil tankers.

2.1 General Description of the Problem

As reported in the article "Volatile organic compounds in oil tankers to be used for propulsion" appearing in Alexander's Gas & Oil Connections, Volume 3, issue #12 for Friday, Apr. 17, 1998, (<http://www.gasandoil.com/goc/reports.rex81660.htm>) during the loading and unloading of crude oil, large quantities of its light components (Volatile Organic Compounds or VOCs) evaporate. Evaporation also occurs during the voyage when the oil splashes around in the cargo tanks.

The tanks are filled with inert gas to prevent the vapors from exploding, the inert gas normally consisting of cleaned combustion gas with an oxygen content below 5% (and hence primarily of nitrogen). To keep the pressure in the storage tanks below 0.14 bar gauge (a typical contemporary design value) the VOC is discharged to the atmosphere through a pipe from the crude oil tanks. The discharged gas, "a mixture of hydrocarbons and inert gas", represents a substantial loss of energy as well as an environmental problem. The non-methane part of the VOC released to the atmosphere reacts in sunlight with nitrogen oxide and may create a toxic ground-level ozone and smog layer detrimental to human health and the environment. Ozone and smog attack mucous membranes (in the eyes and lungs), crops and forests.

2.2 Magnitude of the Problem

As reported in the article "Evaporation of VOCs during voyage less than expected" appearing in Alexander's Gas & Oil Connections, Volume 3, issue #2 for Thursday, Jan. 22, 1998, (<http://www.gasandoil.com/goc/reports.rex80420.htm>), Minton Treharne & Davies (MTD), an analytical and technical consultancy bureau, believes that crude oil cargo loss through evaporation on a typical voyage from the Persian Gulf to north-west Europe is much less than has been indicated in some quarters. MTD disputes suggestions that the VOC (volatile organic compounds) release from a 300,000 dwt VLCC fully-laden with Iranian light crude typically amounts to 0.6% over the course of a passage to Europe. It believes the figure is closer to just 0.01%–0.02%, contesting the projections of cargo loss by engine designer MAN B&W that has referred to measurements which have reportedly pointed to losses of around 0.6% of total cargo volume in this way.

MTD finds that crude oil originating in the Persian Gulf represents a different scenario than applications where crude oil is delivered to a vessel more or less directly from the well, without extensive treatment since Persian Gulf crude has been de-gassified prior to storage in shore tanks, and thus prior to loading into tankers. MTD says the Institute of Petroleum-s PM-L-4A marine loss database panel has correlated crude oil shipment information for many years. Analysis of the voyage data indicates that comparison between the net bill of lading and net outturn figures show a continual decrease in loss from 0.34% in 1989, to 0.25% in 1994 and 0.22% in 1996. Being that the ships and routes are essentially the same, MTD offers no explanation for the differing statistics, nor represents that any systemic decrease is occurring. The range is probably indicative of simple uncertainty.

Overall evaporation loss from all phases of the voyage, including loading and discharge, would therefore seem to be considerably less than the 0.6% figure. While it is appreciated that the majority of evaporative losses occur during loading and discharge operations, especially in the presence of crude oil washing, the total loss is to the order of 0.13%, or nearly five times less than reported, says MTD.

A study undertaken by Exxon and reported by Captain R. C. Uhlin at an IP meeting in London in 1984, according to MTD, indicated that the total loss due to evaporation was 0.13%, of which 0.033% occurred during loading, 0.079% during discharge, and 0.015% on passage.

Being that (i) there is uncertainty in the correct figure, and (ii) many important oil transport passages are longer than passage from the Persian Gulf to Rotterdam, this specification takes the nominal loss of VOCs from oil cargo during the transit portion of the voyage (only) to be of the order of a range from 0.15% to 0.26% by volume.

2.3 Background Regarding Control of the Spillage of Oil From Oil Tankers

The material of this section is substantially derived from the web site of the assignee of the present invention—MH Systems, Inc.—at <www.mhsystemscorp.com>.

Crude oil spills such as the Exxon Valdez incident off the Alaskan coast ignited public concern for the marine environment and prompted congressional legislation to prevent such tragic disasters. The U.S. Government quickly signed into law the Oil Pollution Act of 1990.

This law mandates the installation of double hulls on all new American tankers over 5,000 tons, and phasing out all single hull tankers by the year 2015. This is a costly proposition. Speculation exists among the marine community whether double hulls are the best and only viable solution.

The American Underpressure System (AUPS) presents an alternative. AUPS is the subject of U.S. Pat. No. 5,156,109 for a System to reduce spillage of oil due to rupture of ship's tank, and U.S. Pat. No. 5,092,259 for Inert gas control in a system to reduce spillage of oil due to rupture of ship's tank. It is also the subject of related U.S. Pat. No. 5,343,822 for Emergency transfer of oil from a ruptured ship's tank to a receiving vessel or container, particularly during the maintenance of an underpressure in the tank; U.S. Pat. No.

5,323,724 for a Closed vapor control system for the ullage spaces of an oil tanker, including during a continuous maintenance of an ullage space underpressure; and U.S. Pat. No. 5,285,745 for System to reduce spillage of oil due to rupture of the tanks of unmanned barges. All patents are to the selfsame inventor Mo Husain who is one of the co-inventors of the present invention. The contents of all related predecessor patents are incorporated herein by reference.

The AUPS is retrofittable on existing tankers, and has the similar spill avoidance capability as that of a double hull tanker during accidental rupture of the hull.

The American Underpressure System (AUPS) is a dynamic, state-of-the-art, spill avoidance system which creates a slight vacuum (two to four pounds per square inch) in each cargo tank. This vacuum, assisted by the outside hydrostatic pressure of the surrounding water, prevents or minimizes cargo loss in the event of hull rupture. In case of a bottom rupture caused by grounding, nearly all of the cargo can be protected. In the case of side hull damage, cargo below the level of the damage will be lost, while the cargo above the side hull rupture will be protected.

This system can be used in conjunction with existing inert gas systems that are mandatory on most tankers to prevent explosions.

The AUPS consists essentially of exhaust blowers with their isolation and control valves tapping into the inert gas system. A negative pressure of inert gas is created in the ullage space—the volume of gas above the oil. This negative pressure or underpressure is continuously adjusted and prevents oil from spilling if the tanker is ruptured. Stated simply, the oil is held in the tank by the slight underpressure.

This partial vacuum, or underpressure, assisted by the outside hydrostatic pressure of the surrounding water, prevents or minimizes cargo loss in the event of hull rupture. In case of a bottom rupture caused by grounding, nearly all of the cargo can be protected. In the case of side hull damage, cargo below the level of the damage will be lost, while the cargo above the side hull rupture will be protected.

This negative pressure or underpressure is continuously adjusted and prevents oil from spilling if the tanker is ruptured. Again stated simply, the oil is held in the tank by the slight underpressure.

As of 2001, the environmental threat posed by oil tanker accidents has mandated the use of double-hull construction. However, the phase-out of conventional "single-skin" tankers may last to 2015. One goal of the AUPS system, including as is modified and enhanced by the present invention, is, circa 2001, to provide the protection until all existing single-skin tankers visiting U.S. ports are retired.

2.4 Detail Analysis of the Gaseous Emission of Volatile Organic Compounds From Oil Tankers A portion of the crude oil transported by oil tankers is subject to being lost into the atmosphere as oil vapors, or, more precisely, as volatile organic compounds (VOCs). The components of the oil most likely to be lost are the most volatile components of the crude oil: the naphthas, propanes, butanes and methanes in order of volatility. Unfortunately, these components are also (i) the most valuable parts of the crude oil, and (i) are the most readily taken up into the atmosphere where they constitute pollution.

Setting aside for the moment the emissions of volatile organic compounds that may occur upon the loading and unloading of an oil tanker—which emissions are variously controlled by vapor recovery systems at selected oil loading and unloading ports—there is a considerable loss of oil—and in particular the more volatile components of the oil—during transit. This is because the ullage space gases with which the oil comes into contact are, by such necessity as is next explained, subject to being vented to the atmosphere. All existing oil tankers of tonnage over 20,000 dead weight tons (d.w.t.) transporting oil anyplace in the world must adhere to the standards of the International Maritime Organization (IMO), a part of the United Nations. IMO standards dictate that the ullage space gases in the oil tanks must constantly be both (i) inerted and (ii) maintained at a positive pressure, greater than atmosphere, so as prevent that the oil, or any vapors emitted therefrom, should at any time during the entire loading, transporting and unloading process be subject to combustion or explosion. The ullage spaces of the oil tanks are commonly so inerted, and maintained inert, by being filled with flue gases emitted by the fires which heat the tanker's own boilers. These flue gases are most commonly less than 4% free oxygen ($O_2$), as compared to 21% oxygen in the atmosphere. The dearth of free oxygen in these flue gases means that the combustion of oil, oil vapors, or anything else (not providing its own oxygen) cannot be supported in an atmosphere of these gases.

In order to ensure that any leakage in the ullage space of an oil tanker results in the inerted gases of the tank being vented to atmosphere—as opposed to having atmosphere gases including oxygen ingress into the ullage space—IMO regulations require that ullage space (inerted) gas (mixture) pressure be maintained at greater than atmosphere, specifically as 16.38 pounds per square inch (p.s.i.) where normal average atmosphere pressure is 14.7 p.s.i. Thus an oil tanker, loaded or unloaded, plies the seas with a gas pressure about 1.78 p.s.i. greater than atmospheric in its oil tanks.

The pressure of gases in the ullage spaces of the tanks of an oil tanker is, by IMO regulation, desired to be kept constant, night and day and from day to day. To this end the ullage space of each tank has at least one, and typically several pressure relief valves. If an ullage space gas pressure increases beyond a preset level then undifferentiated gases from the ullage space are vented to atmosphere through the pressure vent valves until the desired pressure is restored. If, by another and complimentary control system, additional gas must be added to one or more ullage spaces to restore the desired gas pressure then this gas is derived from the flue gases of the ship's engines, which flue gases contain insignificant oxygen and which flue gases thus preserve the inerted condition of the ullage spaces.

Gases within the oil are subject to outgassing (i.e., gas within the oil bubbles to the surface), and portions of the oil itself are subject to being volatilized (i.e., liquid components of the oil change into gases). Thus gases from the crude oil enter into the ullage space (inerted) gases, and will do so continuously at a rate determined by temperature and by partial differential pressure until a saturation level is reached. Under normal tanker operating conditions—including while underway with positive tank pressure—the ullage space gases will become saturated with gases emitted from the oil in only a few hours. These emitted gases are all hydrocarbons, and do not contain free oxygen. They thus do nothing to change the inerted condition of the ullage spaces.

There is effectively an inexhaustible source of gases in the crude oil for the purpose of saturating the ullage space gases of the tanks of an oil tanker. In other words, the crude oil will not "run out" of gases that are subject to outgassing, nor of components that are subject to being volatilized, during the course of a voyage of an oil tanker, and the oil will be adequate to saturate the ullage space over and over again with VOCs should that become necessary to maintain a balance of partial gas pressures.

Unfortunately, that is exactly what happens. Ullage space gases containing VOCs are subject to entering the atmosphere by routes shortly to be explained. Although these "lost" gases are in no way desired to be replaced by VOCs from the oil cargo, and are indeed (ultimately) replaced insofar as is possible by (substantially inert) flue gases, each time the quiescent balance of partial gas pressures within the ullage spaces is disturbed, the VOCs will seek to reassume their proper level as is determined by the Gas Laws of science. The Gas Laws dictate that VOC gases within the crude oil will be subject to entering into, and commingling with, the replenished ullage space gases. Insofar as replenished ullage space gases containing these gaseous volatile organic compounds (VOCs) later enter the atmosphere, then these VOCs are lost into the atmosphere. These VOC emissions constitute both (i) economic loss and, presently more importantly at least in the North Atlantic ocean, (ii) pollution. The causes and pathways by which VOCs ultimately enter the atmosphere are several.

2.4.1 Tank Leakage

First, there is some gas leakage directly from the pressurized ullage spaces of the oil tanks into the atmosphere. This is perceived to be slight, and insignificant. The oil tanks are supposed to be sealable air tight, and normally are nearly air tight—especially in larger tankers (supertankers), in more modern tankers which may have seams welded by machine, and in high quality tankers built in reputable shipyards. However, there is no IMO specification for this "airtightness", and individual ships may vary, because the IMO specification has always considered that the only goal, and only standard, is to keep the ullage spaces of the tanks continuously inerted, and little regard has ever been paid to how much ship's flue gases—which are essentially free—it might take to do so.

It will be seen that the ullage space gas control system of the present invention can countenance quite "leaky" ullage spaces without substantial effect on the system ability to establish an maintain such ullage space "underpressure" as accords avoidance of the spillage of oil upon tank rupture. However, "leaky" ullage spaces are adverse to pollution control, and the pollution control aspects of the present invention will be seen to work best when ullage space gas leakage, while not necessarily totally eliminated, is minimized. Luckily, such tankers as have been surveyed by, among other methods, application of soapy water to all seams and joints of oil tanks so as to detect gas leaks, indicate that unintentional, un-valved, leakage of gas from oil tanks is no problem. Even the tanks of existing oil tankers are made to be essentially gas tight. It should also be understood that continuous seam welding is the rule in the construction of oil tanks, and the mating of plates and bulkheads, and, other than slight leakage through seals around vent and fill pipes, there is essentially no place for gases to leak.

It should be noted that, although the ullage space gas control of the present invention will be seen to induce and maintain a pressure less than atmosphere—as opposed to the greater than atmospheric pressure of IMO configuration tanks—within the ullage spaces of the oil tanks, it makes no difference whether the pressure differential that drives tank "leaks" is resultant from a tank pressure that is higher, or lower, than atmosphere. Gases simply flow through leaks from regions of higher pressure to regions of lower pressure. Therefore such leakage as is driven by the approximate +2 p.s.i. pressure differential between the ullage space gases and atmosphere in IMO configuration tankers is revelatory of a reverse leakage to be expected—at least in tankers and tanks not otherwise preconditioned—in the "underpressure" system of the present invention. Accordingly, a few more sentences will be expended to expound on this "tank leakage" topic even though it insubstantially contributes to the pollution emission problem of IMO configuration tankers. (The most substantial source of this problem is set forth in section 2.4.3, following.)

Tank leakage in an existing MO configuration tanker should be considered to be of the same order of magnitude as the equivalent, but opposite direction, gas leakage that can occur in operation of the present invention where a pressure differential between the ullage space gases and atmosphere be approximately from −2 to −4 p.s.i. (Although leakage of oxygen-containing atmospheric gases into, as opposed to out of, the ullage spaces of tanks maintained at an "underpressure" in accordance with the present invention might initially seem not to present any VOC emission problem, any ingress of atmospheric gases into the tanks must ultimately be accounted for, and is not desirable.) So considering the essential equivalence of "leaks out" (in an IMO configuration tank) and "leaks in" (in a tank "underpressurized" in accordance with the present invention), note that the gas tight construction and gas of both liquid and gas portals into the tanks of an oil tanker must be considered when assessing leakage rates. Consider that covers of access hatches and like portals into oil tanks are normally possessed of peripheral seals, such as are made of rubber and held in place by bolts. If the higher gas pressure is that of the atmosphere outside the tank—as will seen to be the case in the present invention—then these covers and their seals will tend to be pressed more firmly into place, helping to avoid leakage. If, on the contrary, the higher pressure is within the tank, then leakage will tend to occur through all sealed joints not tightly mechanically secured. Because it is difficult to reliably seal large areas and large surfaces air tight in the marine environment, little, if any more, gas leakage is projected for the system of the present invention even on tanks that are not preconditioned to preclude gas leakage than the inconsequential amount presently experienced from the pressurized tank ullage spaces of existing IMO-configuration oil tankers.

In simplest terms, leakage due to lack of the tanks being perfectly gas tight is neither (i) a major source of the leakage of VOCs in and from IMO configuration tankers, nor, as another matter, does it present (ii) any major challenge to optimal pollution abatement by the system and method of the present invention, in which system and method completely leak-less, or nearly leak-less, tanks are strongly preferred. It should be understood that, as previously stated, all joints of all tanks of oil tankers are seam, as opposed to spot, welded, and that any leak—liquid or gas—in any tank, howsoever small, constitutes a shipbuilding flaw. Furthermore, if an oil tank leaks, or commences to leak, then the leak can be, should be, and normally is promptly fixed.

2.4.2 Changes in Partial Differential Pressures

Second, there is potentially some modest change in the partial pressure of the gases—the VOCs—emitted from the oil. However, this factor also is not perceived to be critical in causing undesired emission of VOCs.

Consider that to such an extent as, at a time after loading into an oil tanker, the oil becomes (i) very much warmer than it was initially—as might happen in a tanker going from northern realms in winter to tropical waters—and/or (ii) severely agitated—as might happen in a storm—the partial vapor pressure of these gaseous components of the oil may be subject to slightly increase, raising the gaseous pressure in the ullage space. This can give rise to some slight venting of the ullage space gases, including the VOCs, into the atmosphere through the pressure relief valves.

However, the temperature of the oil, which has great mass, primarily responds to the temperature of the partially surrounding sea, and then only but slowly. Moreover, oil within the tanks of large tankers is seldom so severely agitated so as to become airborne, as in the existence of breaking waves within the tanks. Therefore changes in the partial pressure of the (volatile) organic constituent components of the oil is considered to be but a minor contributor to increased ullage space gas pressure, and to any potential venting of ullage space gases, including VOCs, to the atmosphere.

Consider also that if the partial gas pressure of the VOCs increases, it normally so increases but once (as when, for example, the oil has gotten warmer), and this potentially results in the venting of the additional outgasses, and additionally volatilized components of the oil, but one single time.

2.4.3 Diurnal Heating and Cooling of Ullage Space Gases

The third, and critical, problem leading to the continuing loss of ullage space gases—including the loss of such VOCs as are economically and environmentally significant—to the atmosphere is the unavoidable diurnal heating and cooling of the ullage gases themselves.

During the day the sun, especially in such equatorial and other southern realms as are traversed by many oil tankers on many major oil transport routes of the world circa 2001, shines upon the decks of the oil tanker (which are often painted or tarred black or gray), heating the ullage space gases underneath so as to cause their expansion. Such increase in ullage space gas pressure as occurs can be vented through the pressure relief valves in order to remain in compliance with IMO standards. At night the ocean winds cool the decks, which also radiate infrared radiation to space, inducing a cooling and pressure decrease in the ullage space gasses. Flue gasses are then supplied periodically to the ullage spaces in order to maintain compliance with IMO standards. This "leakage" typically goes on day after day during the multi-week voyage of the tanker, ensuring that it "stinks" its way across the ocean, losing a most valuable portion of its oil cargo and supplying into each new day a polluting dose of VOCs suitable to be acted upon by the sun's rays to become smog.

This situation is particularly undesirable in the North Atlantic ocean where, with prevailing westerly winds, pollutant emissions even in mid-ocean contribute to air pollution in Europe. Actually the problem is, if possible, even worse. It is hypothesized (in accordance with the Gas Laws) that the lightest and most volatile gas species are the first to outgas and/or evaporate from the oil, with heavier species appearing more slowly. An oil supertanker larger than Suezmax loading at Abu Dhabi en route to Rotterdam may lose significant naphtha from its oil cargo upon the occasion of venting its tanks while still within the Persian Gulf. By the time the tanker rounds the Cape of Good Hope relatively less naphtha and relatively more propane is being lost. By the time of reaching the North Atlantic the emitted gases are believed to contain relatively higher proportions of butane and methane—heavy species of hydrocarbons that are relatively more innocuous air pollutants—than earlier in the voyage. Although the ullage space gas temperature is likely lower—inhibiting evaporation—in the North Atlantic, it is believed that, at least in Summer, there is adequate daylight for (at the then prevailing temperature) full partial pressure to be reached by all VOCs.

Measurements of VOC emissions due to venting during loading and transit are in the range of 0.15% to 0.26% of total loaded oil cargo, with the accompanying loss of revenue and pollution (ozone and smog). The actual loss is of course dependent upon (i) the duration in day/night heating/cooling cycles of the voyage, (ii) the difference between day and night temperatures (particularly in the ullage spaces), and (iii) the threshold margin above normal tank pressurization at which the pressure relief valves are set to vent ullage space gases to the atmosphere. The easiest way to determine the oil cargo loss is to tightly survey a tanker both when it loaded and when it is unloaded. Any missing cargo must have gone somewhere.

However, as a check—other than simple smelling—on the reasonability of the supposition that oil is being lost to atmosphere, either or both (i) the pressure relief valves, and/or (ii) the inert gas system may be carefully regarded during the course of a tanker voyage. Particularly as regards factor (iii), the pressure relief valves, which are notoriously inaccurate, may be preset, and triggered, to open at pressures as low as 17 pounds per square inch (p.s.i.) where normal average atmosphere pressure is 14.7 p.s.i. and normal ullage space pressure is 16.38 p.s.i. The pressure relief valves will thus be triggered by a gas pressure only about 0.62 p.s.i. greater than prevailing pressure in the ullage spaces of the oil tanks. The pressure relief valves my not reseat and reset until tank pressure is lower than 16.38 p.s.i., making that the just-vented tank is immediately subject to being automatically "topped up" with flue gases from the ship's tank inerting system. Historically it has been, and is now, "no big deal" when the ullage space pressure relief valves open, nor when the ullage spaces vent, nor when the ullage spaces recharge with inert gas. All these events are completely normal and routine, generally unnoticed, shipboard occurrences. Although it is hard to assess exactly how much ullage gas, and the portion of such gas that is VOCs, is lost during any cycle, or during an average cycle, the openings and closings of the ullage spaces pressure relief valves are fully sufficiently frequent, and long lasting, to justify the expectation that oil cargo is being lost in gaseous form.

If an oil supertanker contains, by way of example, some 34 million gallons of oil, then, to use a nominal, medium, loss figure of 0.20% sustained over a nominal 15 day journey, then the cargo loss will be 68,000 gallons. The best and most valuable part of the oil cargo, this product is worth roughly $1 per gallon, making a total economic loss of $68,000 for each loaded transit, or some $680,000 per annum if a nominal 10 round trips per year are made.

Of course, the costs of owning and operating a supertanker are considerable, and the economic cost of product loss during product delivery can be added as a very small fractional increase—in the range of 0.15% to 0.26%—to the cost of the delivered oil. Moreover, the tanker is not susceptible of being directly weighed. (Even the loaded and unloaded draft of the tanker is difficult to measure to the fraction of an inch that is represented by 68,000 gallons.) Neither is the volume (e.g., in gallons) of its oil cargo easily subject to being measured at fractional percentages, especially as and when some oil may remain within the tanks. By dint of the fact that exact oil cargo loss is not easily measured, nor otherwise accounted for, the problem of cargo loss due to emission of VOCs tends not to recognized, and where recognized not to be quantified, and where quantified to be regarded as an inevitable consequence of the transport of oil by sea.

In accordance with the teaching of the present invention next presented, this loss of cargo due to emission of VOCs need not be incurred, or may at least be very substantially abated.

If so much oil product as is presently lost to VOC emissions was instead passed in liquid form into the ocean waters behind the tanker, then the leaking tanker, trailing a film of oil, would be considered a grossly-polluting menace and a pariah. By modern standards (circa 2001), no port nor any major country would let such a leaking tanker enter. However, when oil vapors are passed into the air—which is environmentally much more detrimental—then this pollution cannot be seen, and has regularly been countenanced as inevitable.

2.4.4 Variations in Barometric Pressure as Effects Ullace Space Gases

Barometric pressure, or atmospheric pressure, does not fall so low so that an ullage space being maintained at the ISO standard will, without other changes occurring, cause ullage space pressures to be sensed to be at more than the pressure relief valve differential pressure over the then-prevailing, low, atmospheric pressure. In other words, the pressure relief valves do not open with every passing low pressure weather front.

However, a (i) relatively higher barometric, or atmospheric, pressure upon a first pressure relief valve opening accompanied by (ii) a relatively lower barometric, or atmospheric, pressure upon a subsequent opening can shorten the time between undesirable ventings of ullage space gases. The opposite is true for the opposite relationship; gas venting is conserved between high and low barometric pressure venting incidences.

Consider that the pressure relief valve stays open until the excess pressure over the IMO standard is vented—which IMO standard pressure level is determined as a set differential pressure between (i) tank and (ii) the then-existing atmospheric pressure. If ullage space gases are vented when the barometric pressure is relatively higher, the ullage space pressure will remain relatively higher. If barometric pressure decreases then the differential between (high) ullage space pressure and (low) atmospheric pressure will be earlier reached, and the ullage space gases earlier vented.

The net effect on an entire voyage is a function of the average prevailing atmospheric pressure when and where the tanker is loaded versus where it is unloaded. Although probably insignificant, it is arguable that the fine weather of the Persian Gulf is more often associated with high atmospheric pressure than is the often dreary weather of, by way of example, Amstersdam, and that changes in barometric pressure are adverse to the outbound voyage. The opposite is of course true on the return voyage, but then, as more southern areas are entered, the diurnal temperature swings in the ullage space gases likely increases, and remains the dominant effect.

2.5 Abatement or Elimination of Pollutant Emission from Oil Tankers by Methods or Means Other Than the Present Invention It is neither prior art to, nor necessary for, the completeness of this specification disclosure to speculate on methods or means other than those of the present invention by which pollutant emission from oil tankers might alternatively be abated or eliminated. However, it should be noted that certain apparently efficacious approaches are facile, impossible and/or unavailing.

First, the VOCs could be contained if, contrary to IMO specification, ullage space pressures were permitted to rise, at least within an expanded range, before the ullage space pressure relief valves, possibly of an improved accuracy, were permitted to trigger and to vent ullage space gases. Unfortunately, this not a good idea. Although inerted, the gases of the ullage spaces contain VOCs that are highly susceptible of combustion, even explosive combustion, if and when they can be (i) combined with oxygen in the presence of (ii) a source of ignition. It is bad enough that a pressurized IMO configuration oil tank contains at nominal pressurization (i.e., 16.38 p.s.i) and higher (up to, nominally, 17 p.s.i.) VOCs that, by virtue of pressurization, are in amount greater than would be found in an equal (ullage space) volume pressurized at atmosphere. As ullage space pressure is allowed to grow higher (primarily due to diurnal heating) then the ullage space gases, including the VOCs, will expand with increased force if and when loosed. Normally this loosing of the ullage space gases need not, and will not, happen if the pressure relief threshold is high enough. (Tank integrity is not an issue.) However, loosing of the ullage space gases is exactly what happens in a rupture of the tank ullage space, as is most commonly due to collision of the tanker. In this situation no one wants a cloud containing volatile hydrocarbon gases to expand into volumes of atmosphere containing oxygen, nor into possible sources of ignition, with added force and extent. An ullage space that is pressurized at greater than nominal pressurization (i.e., 16.38 p.s.i), or even greater than the nominal pressure relief threshold (i.e., 17 p.s.i.), is not a "bomb" any more than is an ullage space under normal IMO pressures. But it has—unlike the present invention—increased potential to become one at exactly the wrong moment. For this reason expanding the pressure tolerances of the ullage spaces is a dubious proposition.

It might be countenanced that the decks of the tanks should be made reflective of solar radiation, as with mirror or white surfaces, to resist diurnal heating. These surfaces and/or colors are impractical for the marine environment.

It might be countenanced that the ullage space gases could be maintained at a constant temperature. The decks and sides of a tanker are not insulated. The tanker is exposed to the out of doors with, by definition, at least so much breeze or wind as is generated by the tankers own movement through the water, and most likely much, much more. The energy requirements to heat or cool the ullage spaces of tankers are astronomical, and this approach is completely infeasible.

Finally, a vapor recovery system might be used. If the gases are held as such then the volume required on board the tanker is prohibitive. If the gases are liquified then the energy requirement, not to mention the required equipments, are prohibitive.

SUMMARY OF THE INVENTION

The present invention contemplates the substantial control of the emission of volatile organic compounds (VOCs) from oil tankers during transit by act of (1) maintaining **(1*a*) inerted gases within the (1*b*) sealed ullage spaces of the oil tanks of the oil tanker to be within a (1*c*) range of negative, as opposed to positive, pressures; while (2)** recirculating the (inerted) (negative pressure) ullage space gases in a closed loop.

The (1) maintaining of the gases within the ullage spaces of the oil tanks of the oil tanker at some (1*c*) negative pressure (i.e., a pressure less than atmospheric pressure) serves to prevent the outflow of oil through incipient tank ruptures—all as taught within the aforementioned U.S. Pat. No. 5,156,109 for a System to reduce spillage of oil due to rupture of ship's tank, which patent describes a system and method commonly called (circa 2001) the "American Underpressure System". The fact that the (underpressurized) gases are (1*a*) inerted protects against fire or explosion. This much—that ullage space gases should be maintained (1*a*) inerted at (1*c*) negative pressure—is known in the prior art.

The (1*a*) inerted gases at (1*b*) negative pressure become saturated with gases either (i) outgassing and/or (ii) evaporating from the crude oil cargo. More precisely, the partial pressure of each different gas that is within the oil ultimately rises to its maximum value proportionate to the overall (under) pressure of the ullage space. As with an IMO configuration tanker, the gases added to the ullage space from the oil contain veritably no oxygen, and the inerted condition of the ullage space gases is not altered. The gases added to the ullage space from the oil are also insufficient to significantly change the underpressurization of the ullage space which is initially in the range from −2 to −4 p.s.i. (i.e., 2 to 4 p.s.i. below atmospheric pressure). Depending upon the temperature of the oil and the ullage space, addition of the gases from the oil will perhaps lower the magnitude of the underpressure (i.e., increase the absolute pressure) by some fraction of 1 p.s.i., at which time balance is reached according to the gas equations, and further (i) outgassing and/or (ii) evaporation from the oil cargo substantially ceases. At this time, and in time, the ullage spaces are saturated with VOCs (to such extent as the (under) pressure at which they are maintained dictates). In accordance with the present invention, these VOC-saturated ullage spaces gases will not normally, however, ever be vented to atmosphere—as in the IMO configuration tanker—if at all avoidable. If venting of ullage space gases becomes unavoidable, such as due to excessive tank leakage or rupture, then the ullage space gases, including a proportion of the VOCs, are so vented to atmosphere only in such quantity, and only at such times, and only for so long, as is absolutely necessary. Normally no ventings occur in a properly configured oil tanker during voyages of normal duration.

To accommodate normal variations in gas pressure within the ullage spaces, the present invention contemplates a (1*c*) range of pressures—all negative—in the ullage space of a normal, un-ruptured, ship's tank during the course of a voyage. This may be contrasted with the prior art where only one single (positive) gas pressure is maintained, at least within a narrow range. Negative ullage space pressures within the range are all adequate to, in accordance the aforementioned U.S. Pat. No. 5,156,109, preclude or diminish spillage due to tank rupture.

As in previous, IMO, ullage space gas management methods and systems, in accordance with the present invention, the ullage space of a ship's tank is substantially (1*b*) sealed so that a pressure different from atmosphere can be maintained. However, the present invention is slightly different from the previous IMO approach in that it places new, and more stringent, requirements on this tank (1*b*) sealing. Basically, in the present invention a ship's tank will preferably leak atmospheric gases into the ullage space of the tank at such minuscule amounts, if at all, that neither the (1*a*) inerted nor the (1*c*) underpressurized condition of the tank will need to be re-established during the entire duration of the tanker's voyage. This tank sealing condition is not difficult to realize; tank leaks are detectable with soapy water after the tank is pressurized (opposite to its operational use!), and are readily correctable by welding or tarring.

If, however, either or both of these conditions (1*a*) or (1*c*) should have to be re-established, then neither the operation nor the efficacy of the present invention will be destroyed. If a tank is or becomes leaky in excess of specification, there will be some slight pollution emission at the occasion of extracting sufficient ullage space gases as properly restore the (i) inerted, and/or (ii) underpressure conditions of the tank (to be within proper ranges). However, this emission will generally occur but once or some few times per voyage, and each occurrence will generally emit much less pollutants than a single cycling of the pressure relief valves of an IMO configuration tank.

The (2) recirculating of (inerted) (negative pressure) ullage space gases in a closed loop which is contemplated by the present invention is wholly new. This (2) recirculating is preferably conducted continuously—at least at a low flow level—so as to (2*a*) prudently alleviate any local concentrations of oxygen-containing atmospheric gases as may arise due to regional tank leaks.

The (2) recirculating of ullage space gases in a closed loop may also, optionally, result in a (2*b*) redistributing of gaseous species, and/or the gas concentrations (i.e., the gas pressures of the several ship's tanks) among and between several, or even all, of tanks of an oil tanker. This (2*b*) redistributive recirculating is to the end of balancing out gas fluctuations, normally as are due to one or more slow leaks, that may arise in one or more tanks. The optionally (2*b*) redistributive recirculating accounts for one or some few leaking tanks by spreading the deleterious effects of the leakage over several, or all, tanks; preventing thereby that the (1*a*) inerted, and/or (1*c*) underpressurization, conditions should have to be reestablished in any one tank with an attendant (slight) emission of VOCs.

Finally, the (2) recirculating results in the a regional consolidation of the ullage-space gas management control and/or gas handling equipments at a tanker location remote from the tanks, usually in an aft compartment. Total gas—and attendant VOC emission—management in all the ullage spaces is efficiently effectively centrally realized at a location safely separated from the tanks, and from the zones of collision or grounding damage. From the central gas management location almost anything can be done to any ullage space, both separately and collectively.

The present invention may thus be narrowly regarded as an extension to the system and method of the predecessor patent in that inerted gases of the ullage spaces are now circulated in a "closed loop"—all the while at a pressure less than atmosphere—so as to, among other things, alleviate any potential "hot spots" as might regionally arise in the ullage spaces due to ingress of oxygen-containing atmospheric gases into the tank ullage spaces through leaks.

However, being that those tank ruptures that are accounted for by the tank underpressure system are rare—hopefully occurring less than once during some thousands of voyages—to so conceptualize the present invention as but a modification to the AUPS may be "putting the cart before the horse". The present invention may alternatively, and more broadly, be perceived to first be an oil tanker pollution abatement system and method—applicable on every voyage of every oil tanker (save the maiden voyages of empty tankers)—where (i) the tanks are sealed, and (ii) the ullage spaces gas pressure(s) are maintained within a range less than atmospheric pressure. The same underpressure condition that is necessary for pollution abatement also proves eminently useful for the control of oil spillage through tank ruptures.

1. Operation of the System and Method of the Present Invention

The system, and method, of the present invention controls gases within the ullage spaces of oil tankers, including VOC gases arising from the oil, as follows.

The ullage space of each oil tank is both (i) inerted, and (ii) pressurized to a partial vacuum pressure less than atmosphere—typically an "underpressure" having a center point in the range from −2 p.s.i. to −5 p.s.i.—before leaving the port at which the tanker is loaded. (What is done with gases displaced from the tanks at this port, and also with ullage space gases at the unloading port, is discussed within the PREFERRED EMBODIMENT OF THE INVENTION section of this specification. These gases are basically processed in a shore-based vapor recovery system, if available, in an analogous manner to gases received from an IMO-configuration tanker.)

This "underpressurization" is preferably in accordance with the system and method of the aforementioned U.S. Pat. No. 5,156,109 for a System to reduce spillage of oil due to rupture of ship's tank, and U.S. Pat. No. 5,092,259 for Inert gas control in a system to reduce spillage of oil due to rupture of ship's tank. This "underpressurization" system is commonly called (circa 2001), the "American Underpressure System".

The initial underpressurization is preferably at a level sufficient so that, upon any incipient rupture of the bottom of a system-protected oil tank, sea water will rush into the tank, causing the oil contents of the tank to float upon the water. Because of the underpressure, oil will most particularly not run out of the ruptured tank so as to achieve hydrostatic balance between the fluid (oil) contents of the tank and the then-existing level of the surrounding sea.

In accordance with the present invention the initial underpressurization is preferably set more negative than this threshold value by amount of the total tank gas leakage expected during the duration of the voyage, which expected tank leakage can be both estimated and empirically determined from previous voyages. Still further, the "excess" initial underpressurization is set not only in consideration of the temperature of the oil, and of the ullage space gases, at and where the tank is loaded, and the ullage space is de-pressurized, but also in consideration of the hottest temperature the oil, and the ullage space gases, are expected to reach during the entire voyage. This sounds complicated, but the correct "excess" underpressure may be empirically determined simply by monitoring the (uncorrected) ullage space underpressure for an entire voyage. If the underpressure dips too low (i.e., rises to a less negative level), then the initial "excess" underpressure may simply be set more negative within the safe structural limits of the ship (which are normally at least −6 p.s.i, and more commonly −−8 p.s.i.).

The goal of the "excess" underpressurization is simply this: to create a partial vacuum, or "underpressure", condition in the closed ullage space of each oil tank which condition will suffice to hold the oil contents of the tank from outflow occasioned upon bottom rupture of the tank throughout the entire voyage of the tanker—regardless that atmospheric gases should ingress into the ullage space through leaks, and regardless that ullage space gases should undergo expansion and contractions—without any venting (or extraction) of ullage space gases. Although ullage space gases will be recirculated in a closed loop, each tank is, if possible, effectively sealed both (i) inerted and (ii) underpressurized for the duration of the voyage. In such a "closed system" there are clearly no VOCs emitted to the atmosphere.

Both initial (excess), and encountered (variant), ullage space underpressure conditions are totally without prejudice to doing anything whatsoever, including dynamically pulling a higher or lower underpressure as the case may require, upon the actual occurrence of an incipient tank rupture (or, alternatively, upon such an incipient huge gas leak into the ullage space of the tank as is most likely attributable to human error, as when a crew member opens a tank hatch or valve clearly intended to be sealed for the duration of the voyage.) In simplest terms, if the tanker has suffered a rupture, then the pollution emission control offered by the present invention is potentially (and even likely) sacrificed, and the important thing is to prevent, or further prevent, any outflow of oil (as is taught in U.S. Pat. No. 5,156,109).

Notably, most oil tankers are readily susceptible of having such an initial "excess" underpressure condition set is both (i) structurally safe, and, perhaps surprisingly, (ii) maintainable within a proper range for the protection of tank contents against incipient tank bottom ruptures, for the entire duration of a voyage. For example, the initial "excess" underpressure of the sealed ullage space gas system of a Suezmax oil tanker may be set to −5 p.s.i. at Abu Dhabi which, as the tanker crosses the hot sea of the open Mediterranean, may slip off to −3 p.s.i. only to return to −5 p.s.i. when the oil tanker is finally off-loaded at Rotterdam.

Notably, although the underpressure in the closed system will vary slightly, it will do so entirely within range suitable to serve the primary purpose—taught within the aforementioned U.S. Pat. No. 5,156,109—of protecting the oil contents of the oil tanks of the oil tanker from outflow due to rupture. Notably, even if it is hypothesized that the appropriate underpressure (suitable for bottom rupture) will perhaps not be continuously optimally realized during the hottest days of the hottest part of the voyage, the AUPS system arguably still performs within acceptable norms. Consider that the hottest part of the voyage is generally when the ship is in the deep ocean (or is alternatively within the Suez or Panama canals, where it is unlikely of being ruptured). When in mid-ocean the ship is susceptible only to ruptures of the collision-induced type, and is not subject to grounding. For these ruptures even a slightly elevated underpressure remains suitable.

In simplest terms, the (slight) range of operational underpressures to which tanker ullage spaces are subject by the system of the present invention readily suitably encompasses realistic tanker operation, whereas such range of overpressures as any un-pressure-vented tank of an IMO configuration tanker would be subject is dangerous.

The teaching of the present invention is thus: the tanks of oil tankers should be operated (1) sealed (insofar as is possible, which is normally all time for the reasonably suitable tanks of reasonably suitable tanker undertaking reasonable voyages) (2) at an underpressure. Furthermore, the gaseous contents of the (sealed) ullage spaces should strongly preferably be (3) recirculated in a continuous closed loop.

The purpose of having the (1) sealed system is clear: (i) economically and environmentally unsound emission of VOCs is completely obviated in addition that (ii) the tanks of the tanker have a base level of protection (which can be both augmented and/or tailored) against undesired outflow of oil attendant upon rupture. It may initially seem that the (1) sealing serves only the (i) avoidance of any emission of VOCs, and that the (2) underpressure serves only the (ii) avoidance of oil outflow attendant upon rupture. This is not true: it is only because the ullage space of the oil tank of an oil tanker is operated at an "underpressure" below atmospheric pressure that the tank can effectively be operated sealed, avoiding thereby emission of VOCs. And, of course, it is only because the ullage space of the oil tank of an oil tanker can be as a practical matter sealed (against major flow communication of gases) that the tank can be successfully operated, and hopefully maintained only but passively without intervention, at an underpressure for the duration of a tanker's voyage!

The purposes of the (3) recirculation in the closed loop are several. All local concentrations of oxygen-containing atmospheric gases as may arise in the tank ullage spaces due to regional leaks are appropriately dissipated and diffused. The ullage space gases in any one tank, especially as may accrue atmospheric oxygen contamination and diminishing underpressure, may be distributed among several tanks. A tanker can thus make port completely sealed and un-vented to atmosphere even with a "leaky" tank. Finally, plumbing that supports of the recirculation also permits shipboard consolidation of the ullage space gas handling functions in a safe, secure and readily accessible area.

2. A Method of Managing the Ullage Space of a Tank of an Oil Tanker

Accordingly, in one of its aspects the present invention is embodied in a method of managing the ullage space of a tank of an oil tanker.

A method consists of circulating in a closed loop ullage space gases of a tank of an oil tanker, which ullage space gases are both (i) inerted to contain oxygen below a threshold oxygen level, and (ii) pressurized at a pressure less than a threshold pressure level (which threshold pressure level is less than atmosphere). How the ullage space gases initially get (i) inerted, and (ii) pressurized to a pressure less than atmosphere, is not strictly part within the most basic part of the inventive method. Of course, the circulating ullage space gases so stay (i) inerted, and (ii) pressurized to a pressure less than atmosphere, because the loop in which they circulate is closed—a key feature of the present invention.

The circulating in the closed loop is preferably continuous for the entire duration of a voyage of the oil tanker.

When the circulating in the closed loop is so continuous for the duration of an entire voyage of the oil tanker then, because the closed loop circulating is continuous while the inert condition is maintained for the duration of the voyage of the oil tanker, insufficient oxygen will enter into the ullage space gases by any route so as to cause these ullage space gases to exceed the threshold oxygen level. This simply means that the ullage gases—circulating in the closed loop over the duration of the voyage—are substantially sealed against entrance of oxygen.

Similarly, when the circulating in the closed loop is so continuous for the duration of an entire voyage of the oil tanker then, because the pressure of the gases circulating in the closed loop is maintained less than the threshold pressure (which threshold pressure is less than atmosphere) not only will (i) insufficient oxygen have entered into the ullage space gases by any route so as to destroy the inerted condition of the ullage space gases (as just explained in the immediately preceding paragraph), but, because the closed loop circulating is continuous while the pressure is maintained less than the threshold pressure that is less than atmosphere for the duration of the entire voyage of the oil tanker, (ii) insufficient gas of any nature will have entered into the ullage space gases during the duration of the voyage so as to cause the pressure of the ullage space gases to exceed the threshold pressure. This simply means that the ullage gases—circulating in the closed loop over the duration of the voyage—are substantially sealed against entrance of any gases whatsoever.

Any tanks, pipes, etc. containing the circulating ullage space gases are gas tight to a level that permits that certain threshold conditions involving both the (i) oxygen level, and the (ii) pressure, of the ullage space gases will not be violated during an entire voyage. In practice this is not too difficult to achieve in and for reasonably maintained tanks of reasonable quality oil tankers.

The inerted ullage space gases are preferably so inerted by an addition of flue gases from the oil tanker to the ullage space gases at a time before the oil tanker commences a voyage. The inerted ullage space gases are preferably inerted to less than 4% oxygen by molar volume (the IMO limit which, it should be recalled, applies to ullage spaces gases which, at a positive pressure, better support combustion for better propagating the heats of combustion), and are more preferably inerted to less than 2% oxygen by molar volume (to account for any leaks).

Similarly, the ullage space gases are preferably pressurized (to the pressure less than atmosphere) by subtraction of a portion of the ullage space gases of the oil tanker at a time before the oil tanker commences a voyage. The ullage space gases are preferably so pressurized to a pressure less than a threshold pressure that is itself −2 p.s.i. below atmosphere which, for a nominal atmospheric pressure of 14.7 p.s.i, means to a pressure less than 12.7 p.s.i.

Notably, in the ullage space management gas management method of the present invention the circulating in a closed loop causes that the ullage space gases from the ullage spaces of each of several oil tanks of the oil tanker will be flow communicated to a common location upon the tanker. At this common location both the (i) inerted, and (ii) pressurized, conditions of the separate ullage space gases flow communicated from the several oil tanks will be averaged by creating a gaseous mixture which is a blended hybrid of both the (i) inerted, and (ii) pressurization, conditions of the separate ullage spaces of the several oil tanks. Gases from the blended hybrid gaseous mixture are then supplied back to the several tanks, making that any such ingress of (i) oxygen, and/or (ii) other gases into the circulating gases of some one ullage space as might respectively cause (i) the oxygen content of the gases of this one ullage space to exceed the oxygen threshold, and/or (ii) the pressure of the gases of this one ullage space to exceed the pressure threshold, will become averaged over the several tanks.

3. A Method of Loading at a First Port, Operating During a Voyage, and Unloading at a Second Port, the Several Oil Tanks, Each With an Ullage Space, of an Oil Tanker Having an Inert Gas System (IGS)

In another of its aspects the present invention is embodied in a method of loading at a first port, operating during a voyage, and unloading at a second port the several oil tanks, each with an ullage space, of an oil tanker having an inert gas system (IGS).

The preferred method commences by sealing substantially gas tight, if they are not already so sealed, the empty tanks of an oil tanker at a first port.

The ullage spaces of the unloaded tanks are then rendered inert with the IGS.

Meanwhile, the empty tanks are loaded with oil, all the while first-recovering gases displaced from the tanks during both the rendering inert and the loading to a shore-based first-port vapor recovery system.

There is then next created a predetermined underpressure, being a gas pressure that is below atmospheric pressure, in the ullage space of each loaded tank. Meanwhile, additional gases that are extracted from the ullage spaces of the tanks during the creating of the underpressure are second-recovered to the shore-based first-port vapor recovery system.

By action of the method so far, air pollution at the first port is insubstantial in accordance that ullage space gases are recovered to the shore-based first-port vapor recovery system and are not vented to atmosphere.

Continuing with the preferred method, the gaseous contents of the tank ullage spaces are recirculated in a closed loop during the voyage.

The underpressure (in the ullage space of each and any tank) is change if, and only, upon occurrence of such of the following as do in actuality occur. None of these events need occur: 1) if such a rupture of a tank is experienced as requires making more positive the underpressure of the tank, then venting recirculating gas of the tank to atmosphere, and 2) if any such ingress of atmospheric gases into the ullage space of any tank is detected at a leakage rate which, if persisting for a remaining portion of the voyage, will cause the gaseous contents of the ullage space of the leaking tank to cease to be incombustible, then adding from the IGS such additional inert gas to the ullage space of the leaking tank as will produce, and as will thereafter maintain, as best as is possible, a positive pressure incombustible condition of the ullage space of the leaking tank until the second port is reached.

So far in the method, if neither event 1) nor 2) occurs, as is normal, the closed loop recirculation of ullage space gases has not loosed any portion thereof, particularly including any Volatile organic compound gases, to the atmosphere. Pollution by VOCs from the oil contents of the tanks has been completely avoided.

At this time—when the second, destination, port is reached—the gaseous contents of the ullage spaces of the tanks are first substantially interchanged with inert gas from the IGS, while existing ullage space gases (contaminated with volatile organic compounds) are drawn off to an on-shore second-port vapor recovery facility until a positive tank gas pressure is reached.

A this time liquid oil from each oil tank is unloaded meanwhile that inert gas from shore and/or the tanker's IGS into the tank in order to replace the volume of the oil unloaded from the tank.

Thus the empty tank ends up with a positive pressure of substantially inert gas. Air pollution at the destination port is insubstantial in accordance that ullage space gases are recovered to the shore-based second-port vapor recovery system and are not vented to atmosphere.

4. Eliminating Oxygen "Hot Spots" in Underpressurized Ullage Spaces of Oil Tanks In another of its aspects, the present invention may be considered to be embodied in a method of eliminating oxygen "hot spots" in ullage spaces of oil tanks which ullage spaces are preferably underpressurized.

More precisely, in a preferred method of managing the ullage space of a tank of an oil tanker the ullage space is initially sealed gas tight with its gaseous contents both (i) initially inerted so as to be incapable of supporting combustion of any oil within the tank, and (ii) at an initial pressure less than atmosphere.

This (i) inerted (ii) underpressurized ullage space is thereafter continued closed during the entire voyage of the tanker regardless that 1) ullage space gas pressure should become or temporarily become more positive because of any of (i) leakage of atmospheric gases into the tank, and/or (ii) outgassing of gases within the oil contents of the tank, and/or (iii) evaporation of the oil or portions thereof, and/or (iv) expansion of the ullage space gases upon thermal heating, and/or 2) free oxygen within the ullage space gases should increase because of any leakage of atmospheric gases into the tank.

Finally, the ullage space gases are circulated and recirculated in a closed loop.

By all these steps the ullage space gas pressure remains—nonetheless to potentially becoming more positive—suitably negative throughout the entire voyage of the tanker so as to prevent that hydrostatic pressure within the tank should equalize with a surrounding ocean upon any occasion of incipient rupture of the tank below the water line. Ullage space gas (under) pressure thus continuously precluding at least some outflow of oil as would otherwise occur upon the occasion of the rupture.

By all these steps free oxygen within the ullage space gases remains, nonetheless to potentially increasing, suitably low throughout the entire voyage of the tanker so as to prevent that combustion should occur.

Finally, by all these steps the volume and rate of ullage gas recirculation is at least sufficient to ensure that no concentrations of oxygen-containing atmospheric gases accrue regionally in the tank ullage spaces locally at the sites of leaks.

5. Redundancy in the Flow Communication of Underpressurized Ullage Space Gases in the Oil Tanks of Oil Tankers In yet another of its aspects, the present invention may be considered to be embodied in a system for both (i) establishing and (ii) maintaining an underpressure in the ullage spaces of the tanks of an oil tanker.

The preferred system includes an electrically-powered gas blower for (i) partially extracting the gaseous contents of an ullage space of a tank of an oil tanker in order to establish a pressure less than atmospheric pressure in the ullage space of the tank, and for (ii) circulating and recirculating the gaseous contents of the ullage space all the while at the pressure less than atmospheric pressure.

In a most preferred the electrically-powered gas blowers are (i) redundantly flow-connected in parallel, and (ii) redundantly powered by a plurality of redundant power sources, each power source powering a different one of the electrically-powered gas blowers.

These and other aspects and attributes of the present invention will become increasingly clear upon reference to the following drawings and accompanying specification.

BRIEF DESCRIPTION OF THE DRAWINGS

Referring particularly to the drawings for the purpose of illustration only and not to limit the scope of the invention in any way, these illustrations follow.

DESCRIPTION OF THE PREFERRED EMBODIMENT

The following description is of the best mode presently contemplated for the carrying out of the invention. This description is made for the purpose of illustrating the general principles of the invention, and is not to be taken in a limiting sense. The scope of the invention is best determined by reference to the appended claims.

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

1. System and Method of the Present Invention

The transport of liquid cargo in crude oil tankers holds the potential for polluting the environment from oil spills and evaporative emissions in transit. The American Underpressure System, or AUPS, as it is presently (circa 2001) called that is the subject of U.S. Pat. Nos. 5,156,109, 5,092,259, 5,343,822, 5,323,724, 5,285,745. The AUPS provides the means for spill containment. The present invention extends the AUPS to additionally providing containment of the emission of Volatile Organic Compounds (VOC).

The dual containment ullage gas control system of the present invention provides both (i) emissions abatement or elimination, and (ii) spill containment, when in operation.

Figure 1:
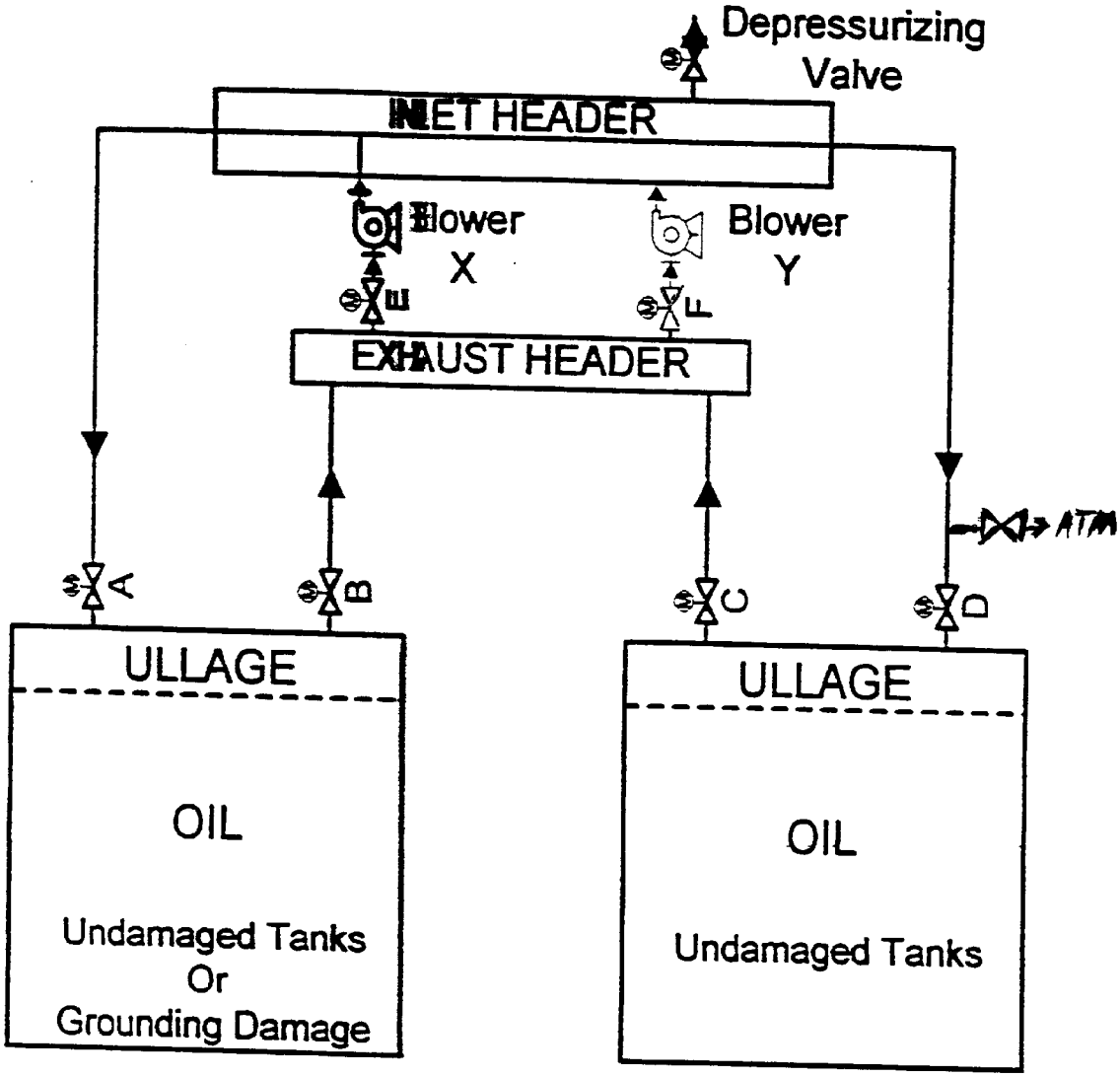
FIG. 1 is a block diagram of the preferred all-inclusive environmental protection configuration of the ullage space gas control system of the present invention during normal transit, or a grounding in which tank bottom rupture has been sustained, of an oil tanker in which the system is installed.
Figure 2:
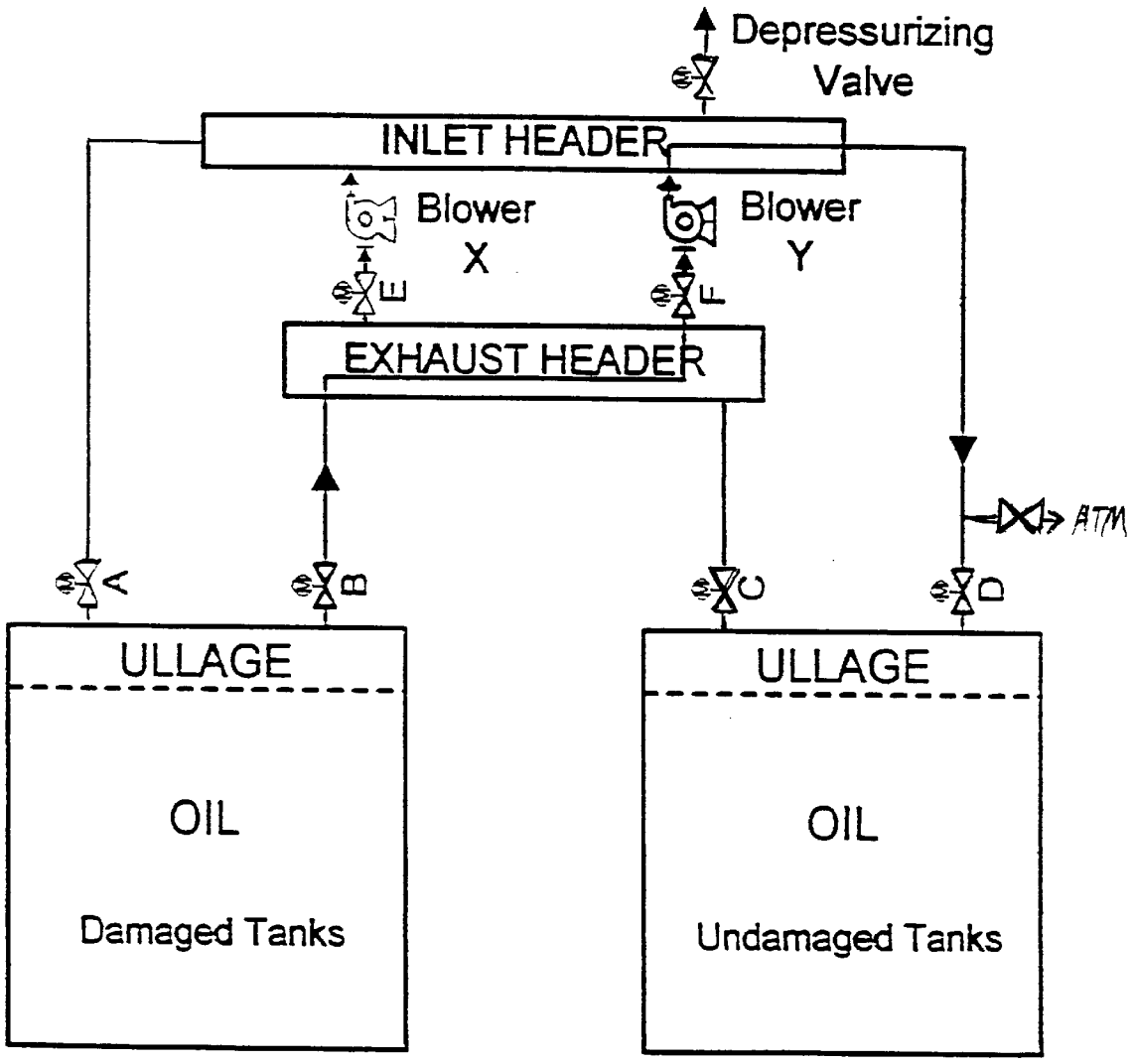
FIG. 2 is a block diagram of the preferred all-inclusive environmental protection configuration of the ullage space gas control system of the present invention, previously seen in FIG. 1, during operation after collision damage, and attendant tank rupture, has been sustained in and by an oil tanker in which the system is installed.
Figure 3:
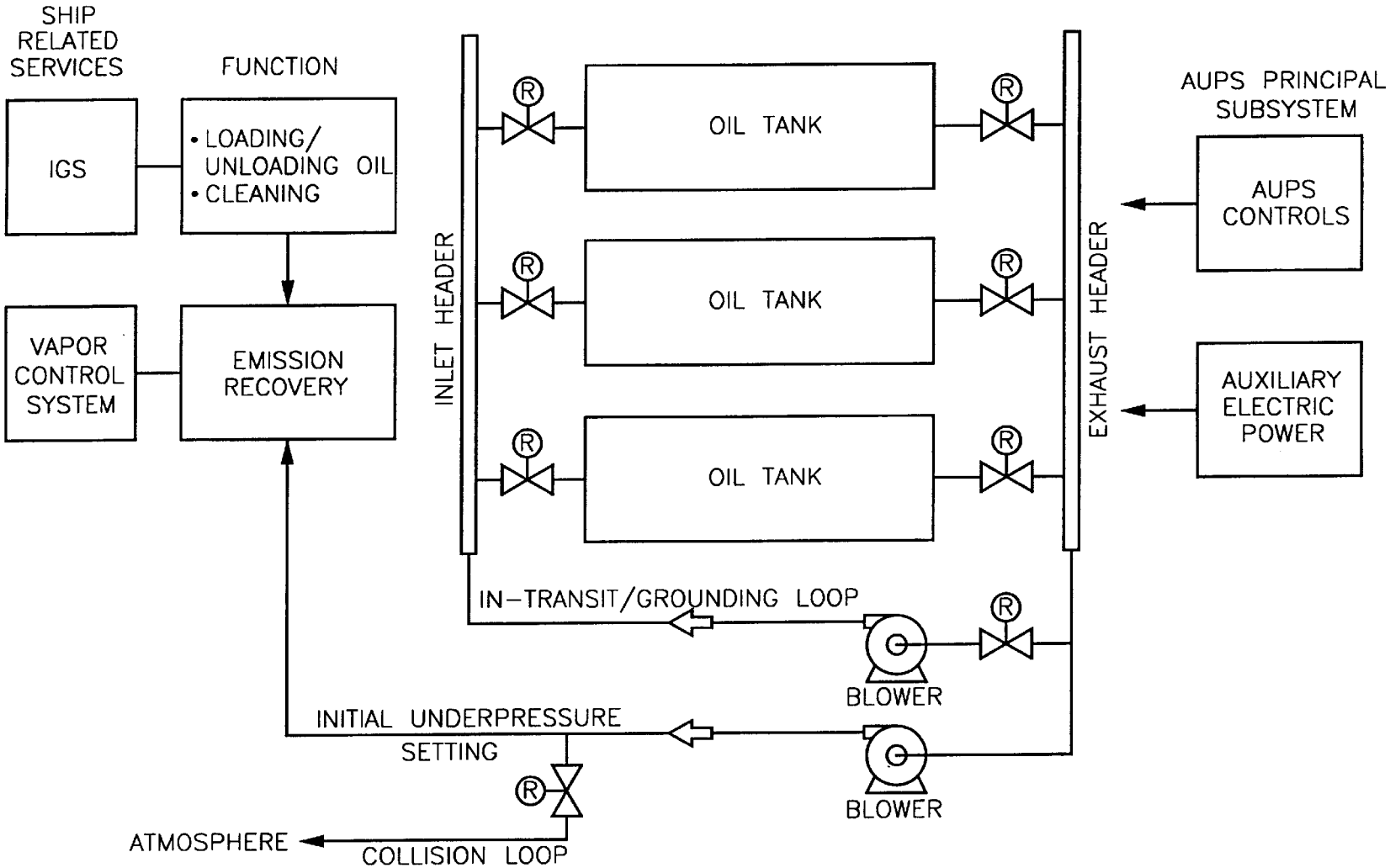
FIG. 3 is a top-level, general, functional block diagram of the supporting systems to the ullage space gas control system of the present invention previously seen in FIGS. 1 and 2.

The preferred arrangement of piping, valves and blowers to provide these functions are shown schematically in FIGS. 1 through 3. Basically, the circulation of ullage gases in a closed-loop configuration is provided by collecting the tank ullage gases into an exhaust header, and returning the gases through a separate inlet header. The headers are connected by 2 separate interconnecting ducts containing a small head blower/valves for routine circulation and the adjoining duct containing a large head blower/valves for casualty-mode circulation. An automated control subsystem will respond to critical placed sensors to perform three major functions: (1) controlling the Underpressure; (2) controlling the oxygen composition of the ullage gases; and, (3) monitoring system status to assist personnel in managing the system and automatically sequencing flow during routine and casualty operational modes.

2. Advantages of the Preferred Closed-Loop Design

A primary purpose of the ullage gas control system of the present invention is to prevent fires and explosions in tankers. This concern mandates the continuous circulation of the inert gases through the ullage spaces to preclude the formation of air gas pockets in the negative pressured ullage spaces.

The other advantages of the preferred system of the present invention are as follows.

First, a simple, dedicated, mechanical arrangement of piping, valves and blowers with automated controls ensures safety and capability to provide dual protection from emissions and oil spills when operating.

Second, negligible evaporation from the crude oil surface after loading—principally due to the high residual concentration of hydrocarbon gases in the ullage spaces (nearing saturation)—is left undisturbed.

Third, the preferred systems has an electrical supply system on a dedicated bus, separate from other ship's electrical systems, which separate bus accords self-sufficiency and independence from other ship's services.

Fourth, any formation of a combustible mixture in the ullage spaces is precluded by continuous monitoring and maintenance of the $O_2$ level below 5%, and a hydrocarbon gas level too rich for combustion.

The air-tightness and resulting tank leakage are minimized by (i) the positive latching forces on tank hatches and closures subject to underpressure, and by (ii) the dedicated, leak-proof, piping of the system.

3. Specific Issues

The preferred closed ullage gas control system of the present invention has two major sources of uncertainty:

First, the increase of ullage pressure from leaked air and outgassing from the crude oil cannot always be precisely accurately predicted in advance. Even when historical empirical data is available, normal variations in tanker age, cargo, route and season of operation can induce variations that are not always precisely predictable. Luckily there is considerable latitude of operation. Pulling a high underpressure of highly inerted ullage space gases at the commencement of a voyage normally provides considerable margin for completing the journey and oil delivery within prescribed norms. However, when the system exceeds these norms (or is predicted to do so during the interval of entering port), then it is a simple matter to recover the tank underpressure albeit at some emission of pollutants.

Second, the buildup of oxygen in the ullage spaces due to leaked air cannot always be precisely accurately predicted in advance. Even when historical empirical data is available, normal can variations in tanker age and flex induced by the sea state(s) encountered en route can induce variations that are not always precisely predictable. Luckily there is considerable latitude of operation in this area also. Again, when the system exceeds these predetermined norms (or is predicted to do so at the pregnant interval of entering port), then it is a simple matter to vent ullage gases and replace them with added inert flue gases, albeit at some emission of pollutants.

The residual concentration after the loading of crude oil (30–50%) is indicative of saturation. Lab testing was performed on crude oils within a range of API 12 to 37, at pressure from 0 to −5 PSIG and at temperature from 67 to 110° F. The liberated gas compositions were measured, and support the saturation assumption set forth in this specification: that is, evaporations during transit will be minimal and not contribute to the ullage space pressure rise.

Cargo loading is the principal source of evaporative emissions that result in a highly concentrated hydrocarbon layer forming on the rising cargo surface that fills the ullage spaces at the end of loading with a residual concentration approaching 50% by volume. A vapor recovery system, if employed, would contain the emissions emitted during loading. Evaporation during transit is minimal, and does not contribute to any ullage space pressure rise.

Quantifying the rate of air leakage is difficult, as there is insufficient data at the current time to make definitive predictions. However, limited data on air leakages of tank assemblies only, suggest 1 $ft^3$/day-tank. Rates of 1–24 $ft^3$/day-tank were applied to a $70\times10^3$ DWT tanker for a 15-day transit. The resulting pressure rise was negligible to a 3% (emission containment of 97%) and the oxygen rose from 1.9% by weight to 2.% by weight—well within the 5% safe value.

4. System Operational Mode Summary

The major preferred supporting systems to the present invention include:

1. Inert Gas System
2. Vapor Recovery System
3. Electric Supply System
4. Emission Recovery System
5. Control Air System
6. Emergency Oil Transfer System.

These supporting systems are shown in the drawings FIGS. 1–3.

The automated control functions of the system and their corresponding supporting instruments are as follows.

The start and stop of AUPS, and the automatic shut-down under certain conditions of malfunctions, are under computer control, and are based on the totality of instrumentation, and are not related to particular instruments.

However, the data acquisition, monitoring, processing and displays of key control functions is primarily realized by a remote console with displays of real time data. This console may be based on either a programmable logic controller or a personal computer.

The ullage pressure control, ullage inerting control, ullage circulation control and valve positioning and control are especially supported by pressure/temperature sensors, the $O_2$/HC analyzers and the tank/draft liquid level sensors Finally, the ullage pressure setting for hydrostatic balance at rupture location is determined by a rupture location sensor.

5. The General Problem of VOC Emissions Addressed by the System of the Present Invention, and Design Considerations in Implementation of the System of the Present Invention In normal practice, VOC emissions occur during the tank loading and transit of oil tankers with an attendant loss of cargo of 0.15 to 0.26 wt % of total loaded cargo, and with accompanying pollution problems (primarily ozone and smog). These same polluting tankers are subject to grounding or collision such as ruptures the oil tanks, additionally resulting in water pollution. The system of the present invention contains both emissions and spills by use of a simple closed-loop inert gas distribution system. Components and controls of the system are substantially independent of tanker and ship services.

The system poses two challenges, or design considerations, that require the solutions hereinafter set forth. First, a build-up of ullage pressure in the ullage spaces resulting from air leakage and/or outgassing from the crude oil can, over time, adversely affect the underpressure required for spill containment. Second, leakage of atmospheric air into the underpressurized (and inerted) ullage spaces can result, over time, with such build-up of oxygen as hazards, or destroys, the inerted state of the ullage space gases.

6. Preferred Configuration of the System of the Present Invention

The distribution of ullage gases in a closed loop is shown with valve and pump sequencing in the system schematics of FIGS. 1 and 2.

FIG. 1 shows the circulation configuration of the system of the present invention during both normal ships's transit and grounding. As such, FIG. 1 can be considered to teach the all-inclusive-environmental-protection operational configuration of the system of the present invention either (i) in transit or (ii) during a grounding condition. Valves A, B, C, D, and E are in an open position. Blower X is in operation. Valve F is in the closed position. Blower Y is shut down.

FIG. 2 shows the circulation configuration of the system of the present invention during a ship's collision where a rapid change in underpressure is required to match the rupture location. As such, FIG. 2 can be considered to teach the all-inclusive-environmental-protection operational configuration of the system of the present invention during collision damage. Valves B, D, and F are in an open position. Blower X is shut down. Valves A, C, and E are in a closed position. Blower Y is in operation.

7. Detail Preferred Operational Modes and Capabilities of the System of the Present Invention The detail preferred operational modes and capabilities of the system of the present invention are as follows.

The operational mode of (i) initial inerting, (ii) inerting during loading/unloading, and (iii) cleaning and gas freeing is based on the capability of normal ship's flue gas or combustion gas systems providing these functions in combination with a vapor-balancing barge and/or on-shore gaseous storage reservoir.

The operational mode of setting a required underpressure before voyage is realized by the capability of the AUPS in combination with the vapor-balancing barge and/or on-shore gaseous storage reservoir.

During transit of the ship the AUPS system provides the required underpressure, inertness and emission control, in accordance with the closed loop circulation of the present invention as shown in FIG. 1.

During casualty operations resultant to grounding the system is maintained similarly to transit status above, with tidal effects and the removal of cargo being accounted for as taught in the previous related patents.

During casualty operations resultant from collision the gaseous circulation and valve/pump sequencing transpires as shown in FIG. 2 with the option to vent to the atmosphere.

8. Dominant Failure Modes and Associated Design Responses of the System

The dominant failure modes and associated design responses of the system of the present invention are as follows.

During a ship electric power supply failure the AUPS has and uses a dedicated power supply in a casualty-free location.

During a control air pressure failure the AUPS has and uses a redundant air storage supply.

In the event of components degradation or failure the use of designed redundant components is automatically initiated by alarms.

In the event of a major leak in the gas piping distribution system all tanks are automatically isolated, initiated by alarms. The subsequent air leaked into the tanks will not create a fire risk because of tank pressure will reach a positive level before the $O_2$ alarm limits are reached, effectively meaning that the ullage space can never support combustion or explosion.

In the event of a large leak in tank or tanks above the cargo level due to collision the system will again revert to the positive pressure mode by, using the ship's inert gas system to maintain a positive pressure, and an inerted condition, in the ullage spaces.

9. Analysis of the Effects of Air Leakage and Outgassing

An exemplary analysis of the effects of air leakage and outgassing on a candidate tanker is as follows. The sample tanker is the Sansinena II of 77,000 DWT, 12 cargo tanks holding 535,000 barrels with an ullage of 24,000 barrels ($1.34\times10^5$ ft$^3$).

Assumed composition of the ullage at the end of loading is as follows:

| Constituents | Mol Fraction | Mol Wt | Wt | % Wt |
|---|---|---|---|---|
| $O_2$ | 0.02 | 32 | 0.64 | 1.86 |
| HC (Propane) | 0.4 | 44 | 17.6 | 51 |
| $N_2$ | 0.58 | 28 | 16.24 | 47 |
| | | | 34.48 | |

The molecular weight (M)=34.48. The density at STP=M/386=0.089 lb/ft$^3$. The initial ullage density at 12.7 psia=0.076 lb/ft$^3$. The initial ullage Wt=$1.34\times10^5\times0.076=10^4$ lbs.

9.1 Effect of Air Leakage on Ullage Pressure Rise in a Closed System

The effect of air leakage on ullage pressure rise is as follows:

Air leakage depends on the tightness of the tanks, the number of penetrations, such as P/V valves, hatch covers, etc., and is influenced more by the number of tanks than the volume of the tanks. Sources of air leakage data to date are very limited and Rosenblatt & Sons, Ship Architects (Private communications) indicate a typical loss of 1 ft$^3$/day-tank. Existing tankers (without the system of the present invention) employing an ICS piping arrangement have frequent toppings of 1 to several days, with resulting high leakage due to the mast riser venting valves/PV valves used frequently for loading cargo. This type of leakage is avoided in the AUPS dedicated piping arrangement with no venting requirements in accordance with the present invention.

Calculating the air leaked into the ullage spaces:

$$\Delta W=\rho_2-\rho_1\times\text{Vol} \qquad \text{(Equation 1)}$$

where:

$\Delta$W=Air leaked into ullage $\rho_2$=Ullage density at end of transit $\rho_1$=Initial ullage density Vol=Ullage volume Equation 1 can be simply expressed as $$\frac{P2}{P1}=1+\frac{\Delta W}{W1}$$

where:

P2=Pressure at transit end

P1=Pressure at start

The leakage rate $Q_L$ is given in the following table:

| leakage rate $Q_L$ | 1 ft$^3$/day-Tank | 24 ft$^3$/day-Tank |
|---|---|---|
| No of Tanks | 12 | 12 |
| No of Transit Days | 15 | 15 |
| Leakage Flow - ft$^3$ | 180 | 4320 |
| Added Weight Flow - $\Delta$W | 13.68 | 328 |
| Initial Ullage Wt (lbs) - W1 | $10^4$ | $10^4$ |
| $\frac{P2}{P1}=1+\frac{\Delta W}{W1}$ | 1.0014 | 1.03 |

9.2 Effect of Air Leakage on Ullage Oxygen Content

The air leakage effect on ullage oxygen content may be calculated as:

$$\frac{W2}{W_{mix}}=\frac{0.019W1+0.23\Delta W}{W1+\Delta W}$$

where:

W2=Wt of $O_2$ at transit end $W_{mix}$=Final wt of ullage 0.019 W1=$O_2$ content in initial ullage (lbs)

0.23 $\Delta$W=$O_2$ content of leaked air (lbs)

This may be expressed in table form as:

| Leakage Rate | 1 ft$^3$/day-Tank | 24 ft$^3$/day-Tank |
|---|---|---|
| Total W1 | $10^4$ | $10^4$ |
| Total $\Delta$W | 13.68 | 328 |
| $\frac{W2}{W_{mix}}$ | $\frac{.019\times10^4+.23\times13.68}{1.0013\times10^4}$ | $\frac{.019\times10^4+.23\times328}{1.0328\times10^4}$ |

9.3 Leakage Effects Summary

A summary of all leakage effects is thus:

| Leakage rate/tank-day | 1 ft$^3$ | 24 ft$^3$ |
|---|---|---|
| Sansinena: Pressure Increase | negligible | 3% |
| Oxygen Change from 1.9% wt | 2% by wt | 2.5% by wt |

To maintain AUPS underpressure for grounding, the maximum venting would be 3% of Ullage weight or emission containment of 97%. The oxygen content of 2.5% by weight is well within the 5% safe value.

9.4 Emission Build-Up in Ullage During Transit

Cargo Loading is the primary source of evaporative emissions that result in a highly concentrated VOC layer forming on the rising cargo surface that fills the ullage spaces at the end of loading, with concentration approaching 50% by volume. This concentration represents the saturation level of the ullage mixture, and subsequent emissions during transit will be minimal and will minimally affect any tank ullage pressure rise.

9.5 Summary of the Analysis

Accordingly, if the two assumptions of 1) tank leakage of from 1–24 $ft^3$/tank-day, and 2) minimal outgassing from the crude oil during the course of ship's transit are both supported then the closed loop configuration of the present invention will be viable for total gas management of the ullage spaces. A specification as to acceptable leakage rates can be imposed for tank acceptance, and the resulting 3% or less pressure rise during the course of an entire voyage can be offset by venting limited (inerted, mixed) tank gases to the atmosphere, for an emission containment of near 97%.

In accordance with these and other possible variations and adaptations of the present invention, the scope of the invention should be determined in accordance with the following claims, only, and not solely in accordance with that embodiment within which the invention has been taught.

What is claimed is:

1. A method of managing the ullage space gases of a tank of an oil tanker comprising:

circulating in a closed loop ullage space gases of a tank of an oil tanker which ullage space gases are both (i) inerted to contain oxygen below a threshold oxygen level, and (ii) pressurized at a pressure less than a threshold pressure level which threshold pressure level is less than atmosphere.

2. The oil tanker ullage space management method according to claim 1 wherein the circulating in the closed loop is continuous for the duration of a voyage of the oil tanker.

3. The oil tanker ullage space management method according to claim 2 wherein the inerted condition of the ullage space gases circulating in the closed loop is continuous for the duration of an entire voyage of the oil tanker;

wherein, because the closed loop circulating is continuous while the inert condition is maintained for the duration of the voyage of the oil tanker, insufficient oxygen will have entered into the ullage space gases by any route so as to cause the ullage space gases to exceed the threshold oxygen level;

wherein the ullage gases are circulating in the closed loop that is, over the duration of the voyage, substantially sealed against entrance of oxygen.

4. The oil tanker ullage space management method according to claim 3 wherein the pressure of the ullage space gases circulating in the closed loop is maintained less than the threshold pressure, which threshold pressure is less than atmosphere, continuously for the duration of the entire voyage of the oil tanker;

ergo, not only will insufficient oxygen have entered into the ullage space gases by any route so as to destroy the inerted condition of the ullage space gases, but, because the closed loop circulating is continuous while the pressure is maintained less than the threshold pressure that is less than atmosphere for the duration of the entire voyage of the oil tanker, insufficient gas of any nature will have entered into the ullage space gases during the duration of the voyage so as to cause the pressure of the ullage space gases to exceed the threshold pressure;

wherein the ullage gases are circulating in the closed loop that is, over the duration of the voyage, substantially sealed against entrance of any gases.

5. The oil tanker ullage space management method according to claim 1 wherein the inerted ullage space gases are so inerted by an addition of flue gases from the oil tanker to the ullage space gases at a time before the oil tanker commences a voyage.

6. The oil tanker ullage space management method according to claim 1 wherein the inerted ullage space gases are so inerted to less than 4% oxygen by molar volume.

7. The oil tanker ullage space management method according to claim 1 wherein the ullage space gases pressurized at a pressure less than a threshold pressure level, which threshold pressure level is itself less than atmosphere, are so pressurized less than atmosphere by subtraction of a portion of the ullage space gases of the oil tanker at a time before the oil tanker commences a voyage.

8. The oil tanker ullage space management method according to claim 7 wherein the ullage space gases are pressurized to a pressure less than a −2 p.s.i. threshold pressure level below nominal atmospheric pressure of 14.7 p.s.i, or to a pressure less than 12.7 p.s.i.

9. The oil tanker ullage space management method according to claim 1 wherein the ullage space gases are inerted to less than 4% oxygen by molar volume.

10. The oil tanker ullage space management method according to claim 9 wherein the ullage space gases are inerted to less than 2% oxygen by molar volume.

11. The oil tanker ullage space management method according to claim 1 wherein the circulating in a closed loop comprises:

flow communicating ullage space gases from the ullage spaces of each of a multiplicity of oil tanks of the oil tanker to a central point upon the tanker;

balancing at the central location both the (i) inerted, and (ii) pressurized, conditions of the ullage spaces flow communicated from the multiplicity of oil tanks, creating a gaseous mixture which is a blended hybrid of both the (i) inerted, and (ii) pressurization, conditions of the ullage spaces of the plural oil tanks; and supplying from the central location gases from the blended hybrid gaseous mixture back to the plural ones of the multiplicity of tanks;

wherein any such ingress of (i) oxygen, and/or (ii) other gases into the circulating gases of some one ullage space as might respectively cause (i) the oxygen content of the gases of this one ullage space to exceed the oxygen threshold, and/or (ii) the pressure of the gases of this one ullage space to exceed the pressure threshold, is averaged over plural ones of the multiplicity of tanks.

12. A method of managing the ullage space of a tank of an oil tanker comprising:

sealing substantially gas tight an ullage space of a tank of an oil tanker with the gaseous contents of the ullage space both (i) initially inerted so as to be incapable of supporting combustion of any oil within the tank, and (ii) at an initial pressure less than atmosphere; and continuing closed the tank's inerted underpressurized ullage space during the entire voyage of the tanker regardless that 1) ullage space gas pressure should become or temporarily become more positive because of any of (i) leakage of atmospheric gases into the tank, and/or (ii) outgassing of gases within the oil contents of the tank, and/or (iii) evaporation of the oil or portions thereof, and/or (iv) expansion of the ullage space gases upon thermal heating, and 2) regardless that free oxygen within the ullage space gases should increase because of any leakage of atmospheric gases into the tank; and circulating and recirculating the ullage space gases in a closed loop;

wherein the ullage space gas pressure remains, nonetheless to potentially becoming more positive, suitably negative throughout the entire voyage of the tanker so as to prevent that hydrostatic pressure within the tank should equalize with a surrounding ocean upon any occasion of incipient rupture of the tank below the water line, thus continuously precluding at least some outflow of oil as would otherwise occur upon the occasion of the rupture; and wherein free oxygen within the ullage space gases remains, nonetheless to potentially increasing, suitably low throughout the entire voyage of the tanker so as to prevent that combustion should occur; and wherein the volume and rate of ullage gas recirculation is at least sufficient to ensure that no concentrations of oxygen-containing atmospheric gases accrue regionally in the tank ullage spaces locally at the sites of leaks.

13. The method according to claim 12 wherein the substantially gas tight sealing of the ullage space is with (i) gas initially inerted by addition of flue gases from the tanker.

14. A method of loading at a first port, operating during a voyage, and unloading at a second port the several oil tanks, each with an ullage space, of an oil tanker having an inert gas system (IGS), the method comprising:

1) sealing substantially gas tight, if they are not already so sealed, the empty tanks of an oil tanker at a first port; then 2) rendering inert with the IGS the ullage spaces of the unloaded tanks, and continuing the rendering while 3) loading the empty tanks with oil; all the while 4) first-recovering gases displaced from the tanks during both the rendering inert and the loading to a shore-based first-port vapor recovery system; then 5) creating a predetermined underpressure, being a gas pressure that is below atmospheric pressure, in the ullage space of each loaded tank, while 6) second-recovering additional gases that are extracted from the ullage spaces of the tanks during the creating of the underpressure to the shore-based first-port vapor recovery system;

wherein air pollution at the first port is insubstantial in accordance that ullage space gases are recovered to the shore-based first-port vapor recovery system and are not vented to atmosphere; then 6) recirculating in a closed loop during the voyage the gaseous contents of the tank ullage spaces; while 7) changing during the voyage of the tanker the underpressure in the ullage space of each and any tank only upon occurrence of such of the following as do in actuality occur 7a) if such a rupture of a tank is experienced as requires making more positive the underpressure of the tank, then venting recirculating gas of the tank to atmosphere, and 7b) if any such ingress of atmospheric gases into the ullage space of any tank is detected at a leakage rate which, if persisting for a remaining portion of the voyage, will cause the gaseous contents of the ullage space of the leaking tank to cease to be incombustible, then adding from the IGS such additional inert gas to the ullage space of the leaking tank as will produce, and as will thereafter maintain, as best as is possible, a positive pressure incombustible condition of the ullage space of the leaking tank until the second port is reached; at which time 8) first substantially interchanging the gaseous contents of the ullage spaces of the tanks with inert gas from the IGS, while 9) drawing off existing ullage space gases to an on-shore second-port vapor recovery facility until a positive tank gas pressure is reached; and then 10) unloading liquid oil from each oil tank; while 11) supplying inert gas from the IGS into the tank in order to replace the volume of the oil unloaded from the tank, the empty tank ending up with a positive pressure of substantially inert gas;

wherein air pollution at the destination port is insubstantial in accordance that ullage space gases are recovered to the shore-based second-port vapor recovery system and are not vented to atmosphere.

15. A system for establishing and maintaining an underpressure in the ullage spaces of the tanks of an oil tanker comprising:

an electrically-powered gas blower for (i) partially extracting the gaseous contents of an ullage space of a tank of an oil tanker in order to establish a pressure less than atmospheric pressure in the ullage space of the tank, and for (ii) circulating and recirculating the gaseous contents of the ullage space all the while at the pressure less than atmospheric pressure; and a valve for first flow connecting the gas blower for the (i) partially extracting, and for second flow connecting the gas blower for the (ii) circulating.

16. The system according to claim 15 wherein the electrically-powered gas blower comprises:

a plurality of gas blowers redundantly flow-connected in parallel.

17. The system according to claim 15 wherein the plurality of electrically-powered gas blowers are redundantly powered by a plurality of redundant power sources each for powering a different one of the plurality of electrically-powered gas blowers.

18. In a system for establishing and maintaining incombustible an ullage space of a tank of an oil tanker having a source of inert gas, and inerting means for charging the ullage space of the tank of the oil tanker with such an amount of inert gas from the source of inert gas as renders the gaseous contents of the ullage space incombustible, an improvement comprising:

a gas recirculating means for circulating in a closed loop the incombustible gaseous contents of the ullage space of the tank so that oxygen will never sufficiently accumulate regionally locally within the tank due to a proximately-located gas leak in the tank so as to regionally locally negate the non-combustibility of the ullage space gases.

* * * * *